US006164081A

United States Patent [19]

Jensen et al.

[11] Patent Number: 6,164,081

[45] Date of Patent: Dec. 26, 2000

[54] PROCESS FOR REGULATING A REFRIGERATING SYSTEM, REFRIGERATING SYSTEM AND EXPANSION VALVE

[75] Inventors: Kenn Sønder Jensen; Frede Schmidt, both of Sønderborg, Denmark

[73] Assignee: Danfoss A/S, Nodborg, Denmark

[21] Appl. No.: 09/308,508

[22] PCT Filed: Nov. 14, 1997

[86] PCT No.: PCT/EP97/06357

§ 371 Date: May 19, 1999

§ 102(e) Date: May 19, 1999

[87] PCT Pub. No.: WO98/22763

PCT Pub. Date: May 28, 1998

[30] Foreign Application Priority Data

Nov. 19, 1996 [DE] Germany ..... 196 47 718

[51] Int. Cl.[7] ..... F25B 41/04

[52] U.S. Cl. ..... 62/115; 62/224; 236/92 B

[58] Field of Search ..... 62/225, 224, 222, 62/115; 236/92 B

[56] References Cited

U.S. PATENT DOCUMENTS

| | | | |
|---|---|---|---|
| 4,879,879 | 11/1989 | Marsala et al. | 62/225 |
| 5,148,978 | 9/1992 | Stapelbroek | 62/225 |
| 5,195,331 | 3/1993 | Zimmern et al. | 62/225 |

*Primary Examiner*—William E. Tapolcai
*Attorney, Agent, or Firm*—Lee, Mann, Smith, McWilliams, Sweeny & Ohlson

[57] ABSTRACT

In a process for regulating a refrigeration system (1) using an expansion valve (4), one side of the regulating member is pressed by the pressure of refrigerant at the evaporator side and the other side of the regulating member is pressed by the vapor pressure of a sensor system (22) whose sensor temperature is determined by the refrigerant saturation temperature and by the heat supplied by a heating element (27). heat supply is regulated depending on a measurement value (overheating or liquid level). Also disclosed is a refrigeration system (1) regulated in this manner and an expansion valve (4) as essential component of such a system. An improved, exonomic and universally applicable regulation can thus be obtained.

31 Claims, 4 Drawing Sheets

Fig.2
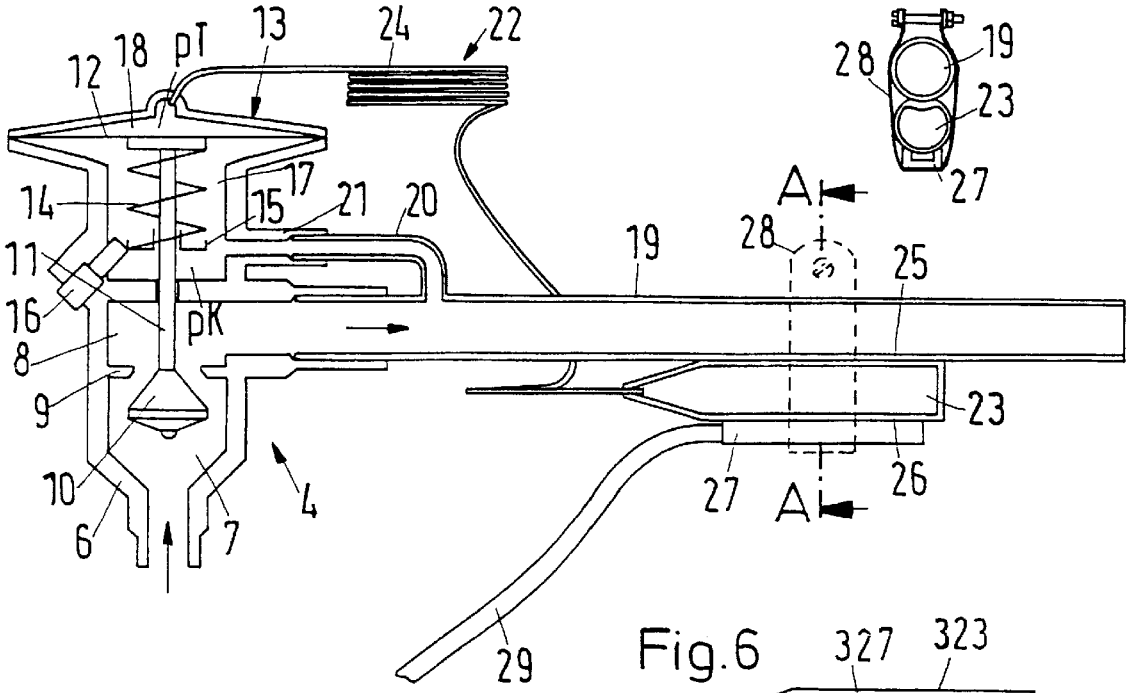
Fig.3
Fig.6
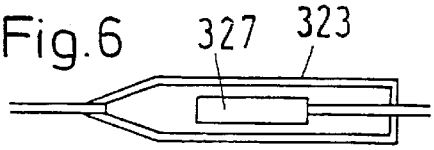
Fig.4
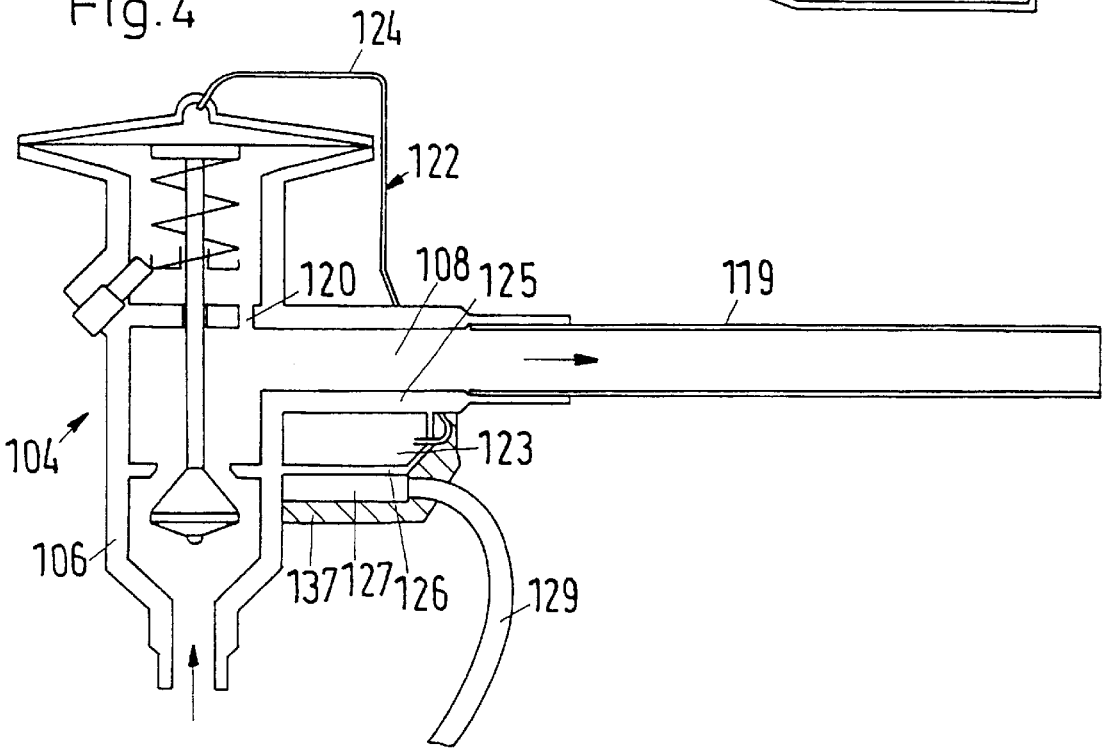

PROCESS FOR REGULATING A REFRIGERATING SYSTEM, REFRIGERATING SYSTEM AND EXPANSION VALVE

The invention relates to a method for controlling a refrigeration system, to a refrigeration system and to an expansion valve for such a refrigeration system.

From WO 82/04142 is known a refrigeration system having in series a compressor, a condenser, an expansion valve and an evaporator. This system is controlled by the expansion valve having as actuator a diaphragm or a bellows and can be acted upon by a heat supply from a heating element. One side of the actuator is biased by the vapour pressure of a liquid-vapour filled sensor system, whose sensor temperature is determined by heat supply. The superheat is measured on the outlet side of the evaporator, and the heat supply is controlled in dependence of the measured value. The heatable sensor is mounted on the outlet side refrigerant line of the evaporator, where superheated refrigerant vapour is already available. Therefore, the heat dissipation is relatively low and changes concurrently with the superheat temperature.

From DE 40 05 728 A1 is known a refrigeration system, which is controlled in dependence on superheat at the evaporator outlet. For that purpose, the expansion valve has an actuator in the form of a diaphragm, one side of which is biased by the refrigerant pressure at the evaporator outlet and the other side of which is biased by a pressure corresponding to the refrigerant temperature at the evaporator outlet. This control requires either the intake line leading to the compressor or a measuring line in the form, for example, of a capillary tube, to be run right up to the expansion valve. This frequently leads to restrictions in the design of the refrigeration system. In addition, the control is often very unstable, with wildly fluctuating superheat.

In the known case, this superheat control has an additional influence imposed on it, derived from the temperature in the line between compressor and condenser. For that purpose, one of the two pressure chambers of the diaphragm capsule is filled with a control medium, which through the diaphragm capsule is heated by heat-exchange with the superheated refrigerant at the outlet of the evaporator and is additionally heated by a heating element, for example, a PTC resistor.

From U.S. Pat. No. 3,313,121 is known a refrigeration system and a method for controlling a refrigeration system by means of an expansion valve having as actuator a diaphragm, one side of the diaphragm being acted upon by the refrigerant pressure on the outlet side of the expansion valve, the other side being acted upon by the pressure of a sensor mounted on the superheat path of the evaporator.

The invention is based on the problem of improving control of a refrigeration system using simple and inexpensive means.

In this practical form the sensor is in continuous thermal contact with liquid refrigerant, which gives a good heat transmission at substantially constant temperature conditions. The opening degree of the valve is determined substantially by the heat supply by means of the heating element, since it is by the heating that the vapour pressure in the sensor system is increased, as the heating increases the pressure in the sensor system. The filling, whose pressure is temperature dependent, can either be a liquid-vapour filling or an adsorption filling. Here, the vapour pressure is a function of the temperature and increases with increasing temperature. The greater is the power supplied to the heating element, the greater is the opening degree of the valve. Proportionality is practically achieved by the following relationship:

$$E-K\times A\times(T_f-T_s)$$

E=the power supplied to the heating element
K=heat transfer coefficient
A=heat transfer surface between sensor and refrigerant
$T_f$=sensor temperature
$T_s$=saturation temperature of the refrigerant at the valve outlet.

This relationship applies regardless of how high saturation pressure and saturation temperature of the refrigerant at the valve outlet are at the time. The opening degree of the valve is therefore independent of the evaporator pressure. Any compensation by means of the heating element is not necessary.

Since the heat supply is controlled, that is, is pre-set by a controller, all automatic control engineering options can be applied to improve the control, for example a PI controller can be used. Moreover, further miscellaneous functions, such as a dependency on compressor speed, icing up, or undue increase in temperature of the compressed refrigerant, can be taken into account. This enables control to be very accurate. A further advantage consists in that the expansion valve closes when the heating element fails.

The refrigerant pressure or the refrigerant temperature only need to be detected at the outlet side of the expansion valve. A line connection between the outlet of the evaporator and the expansion valve is not required. Simple signal lines suffice for the connection between the measuring points and the controller, and a simple electrical lead provides the connection between the controller and the heating element. This results in a simple and inexpensive construction. When adapting the refrigeration system to a specific application the line layout can be chosen with greater freedom than previously. The control principle is suitable not only for dry evaporators, in which superheat is measured, but also for flooded evaporators, in which the level of liquid is used as measuring value. All this allows very versatile use.

In another form of the invention a small amount of refrigerant is continuously released, also when the expansion valve is closed.

In accordance with the apparatus according to the invention, providing are two alternatives for the detection of the saturation temperature.

When, the tube is a capillary tube, this tube can form both the bypass channel and the second throttling point. This double function saves additional components.

It is recommendable when, the outlet channel is connected with the outlet side of the expansion valve. The expression "outlet side of the expansion valve" includes the entire region between the throttle point of the expansion valve and the actual inlet of the evaporator, even when changeover valves, distributors or other built-in components are present. There is therefore considerable freedom of scope for mounting the sensor and the compensating channel.

It is especially advantageous, however, for these components to be arranged close to the expansion valve, because then the connecting routes involved are short. However, it is also important that the pressure in the compensating channel is equal to the pressure in the mounting spot of the temperature sensor.

When the compensating channel is from a refrigerant line at the outlet of the expansion valve to one of the pressure chambers, only a short pipe is needed to connect the refrigerant line to the one pressure chamber.

An even cheaper solution is provided if the compensating channel is routed in the interior of the valve.

The capillary tube connected from the sensor to the pressure chamber results in a clear separation of the sensor temperature and the temperature in the pressure chamber.

In the construction the refrigerant line adjoining the outlet of the expansion valve forms a preferred carrier for sensor and heating element. A strap retainer can be used for fastening.

In one form of the invention, the sensor is arranged in or on the outlet side housing part of the expansion valve, wherein in another form of the invention the sensor can be formed by a chamber in the housing part.

In a preferred embodiment of the invention, the heating element is arranged inside the sensor. This produces an even better heat transfer and facilitates assembly.

The heat insulation covering the sensor or the heating element helps prevent faults through heat radiation into the surroundings.

An important component of the refrigeration system, which is also treated separately, is the expansion valve. All necessary elements are located in the expansion valve or in the immediate vicinity thereof.

For practical operation, it is advantageous when, the valve housing, the compensating channel and the sensor system form a pre-assembled module, which may include, the refrigerant line adjoining the valve outlet.

Advantageously, the expansion valve can also be provided with a bypass channel.

BRIEF DESCRIPTION OF THE DRAWINGS

The invention is explained in greater detail hereinafter with reference to preferred embodiments illustrated in the drawings, in which:

FIG. 2 is a diagrammatic view of an expansion valve, FIG. 3 is a section along the line A—A in FIG. 2, FIG. 4 is a diagrammatic view of a modified expansion valve, FIG. 6 shows a modified sensor.

DESCRIPTION OF THE PREFERRED EMBODIMENTS

Figure 1:
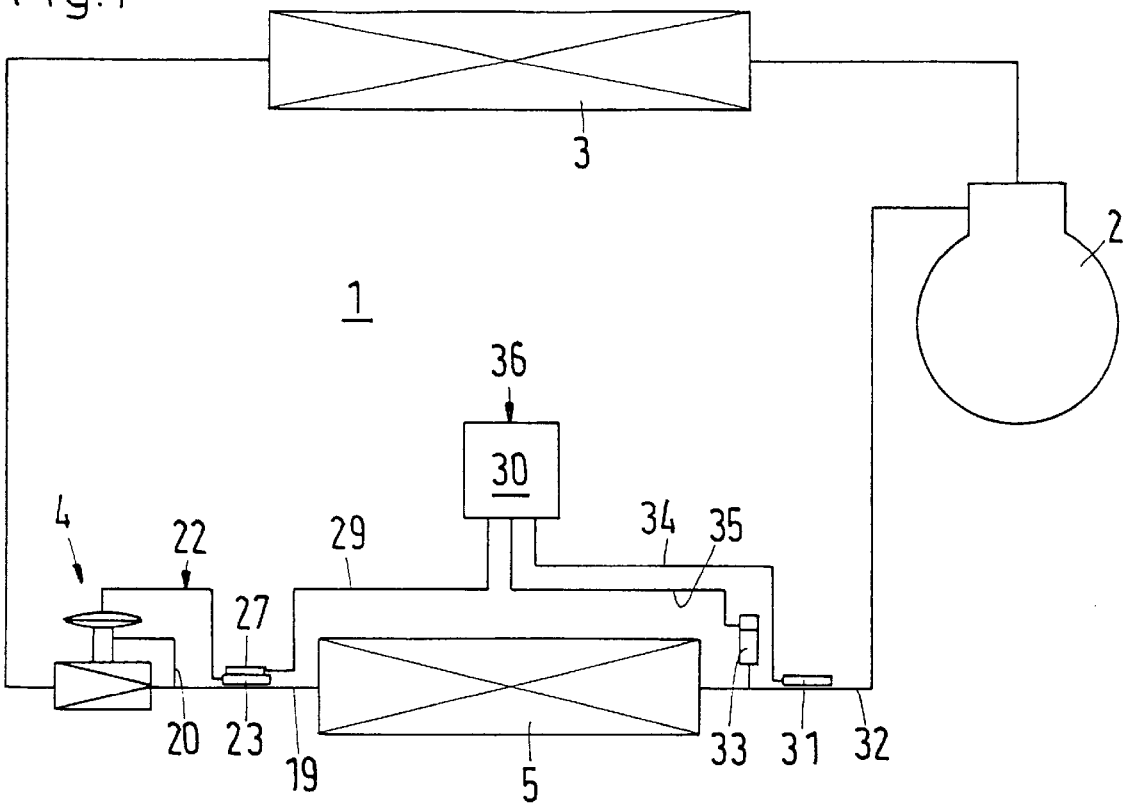
FIG. 1 is a circuit diagram of a refrigeration system according to the invention with a through-flow evaporator.

FIG. 1 shows a refrigeration system 1 in which a compressor 2 for the refrigerant, a condenser 3, an expansion valve 4 and a dry evaporator 5 are arranged one behind the other in series. A dry evaporator shall be understood to mean an evaporator in which all the refrigerant is evaporated during a single passage through the evaporator.

The expansion valve 4 can be of the form, for example, illustrated in FIG. 2. A valve housing 6 has an inlet chamber 7 and an outlet chamber 8, between which a valve seat 9 is located. The associated closure member 10 is carried by a valve stem 11, which co-operates with an actuator 12 in a diaphragm box 13. The closure member 10 is acted upon by a spring 14, the mounting plate 15 of which spring is adjustable by means of an adjusting device 16; the closure member is also acted upon by the pressure pK in a lower pressure chamber 17 and in the opposite direction is acted upon by the pressure pT in an upper pressure chamber 18. A refrigerant line 19 in the form of a copper pipe is connected to the chamber 8 located on the outlet side. The refrigerant line's interior is connected by way of a compensating channel 20 in the form of a pipe to a connector 21, which leads to the lower pressure chamber 17. The pressure pK therefore corresponds to the refrigerant pressure at the outlet of the expansion valve 4.

The upper pressure chamber 18 is part of a sensor system 22, the sensor 23 of which is connected by way of a capillary tube 24 to the upper pressure chamber 18. The sensor 23 is located with a first wall portion 25 against the refrigerant line 19. A second wall portion 26 on the opposite side serves for mounting an electrically heatable heating element 27. A retaining means 28, for example a strap or band, serves to secure the sensor 23 and the heating element 27 to the refrigerant line 19. Current supply to the heating element 27 is effected by way of an electrical lead 29. The sensor system 22 contains a liquid-vapour filling, which means that the pressure pT in the pressure chamber 18 is the same as the saturation pressure of the filling medium at the particular sensor temperature.

As furthermore shown in FIG. 1, for operation of the expansion valve 4 only a single connecting element, namely, the electrical lead 29, has to be taken into the region of the expansion valve 4. The heat output to be delivered by the heating element 27 is pre-set by a controller 30, which receives as actual value the instantaneous superheat, that is the difference between the actual refrigerant temperature and the saturation temperature. For that purpose, in known manner, the refrigerant temperature is measured with a temperature sensor 31, which is located on the outlet line 32 of the evaporator, and the refrigerant pressure, which is equivalent to the saturation temperature, is measured with a pressure sensor 33, which is connected to the interior of the line 32. The measured values are supplied to the controller 30 via signal lines 34 and 35. The sensors 31 and 33 can be electronic sensors that transmit electrical signals via the signal lines. An inlet 36 indicates that yet further influences apart from superheat can be made operative.

The filling medium in the sensor system is chosen with reference to the refrigerant so that with no heating the sensor pressure pT above the actuator is somewhat higher than the refrigerant pressure pK below the actuator. The pressure ratios are matched, however, so that by virtue of the spring 14 the force acting from below is somewhat larger than the force acting from above. The expansion valve is therefore closed when there is no heating. Just a slight supply of heat is sufficient, however, to open the valve. In addition, precautions are taken to ensure that the summation curve of spring force and refrigerant pressure pK in the control range is an approximately constant distance from the curve of the sensor pressure pT. By means of the spring 14 a value of superheat, for example, 4°, is set. As soon as this is exceeded, the expansion valve opens.

In operation, a reference value is set at the controller 30, preferably a PI controller, and is compared with the measured value of superheat. In dependence on the deviation of the measured values from the reference value, the heat output is controlled so that continuous operation with few fluctuations is achieved. In this connection the opening degree of the valve is proportional to the heat output supplied, irrespective of the level of the evaporator pressure in the refrigerant line 19.

It is furthermore apparent from FIG. 2 that although the expansion valve itself is a standard valve, supply to the connections of the two pressure chambers 17 and 18 is effected in a novel manner. Because all connections can be made just after the expansion valve, valve housing 6, compensating channel 20, sensor system 22 and refrigerant line 19 can be delivered in the form of a pre-assembled module.

The electrical lead 29 and the signal lines 34 and 35 can be installed without difficulty in the appliance containing the refrigeration system, which contributes to a further reduction in costs.

In FIG. 4, reference numbers increased by 100 have been used for corresponding parts. One difference is that the compensating channel 120 is provided in the form of an internal bore in the housing 106. In addition, a chamber in the valve housing 106 serves as sensor 123, the chamber with one wall portion 125 adjoining the chamber 108 of the valve housing 106 located on the outlet side, and on the other side having a wall portion 126 which, unencumbered, faces outwards and serves for mounting the heating element 127. Sensor 123 and heating element 127 are covered by heat-insulation 137 to prevent loss by radiation to the outside.

In this construction a new kind of valve is provided, which has all the essential features in and on its housing, and which can be pre-assembled as a module, with or without the refrigerant line 119.

Figure 5:
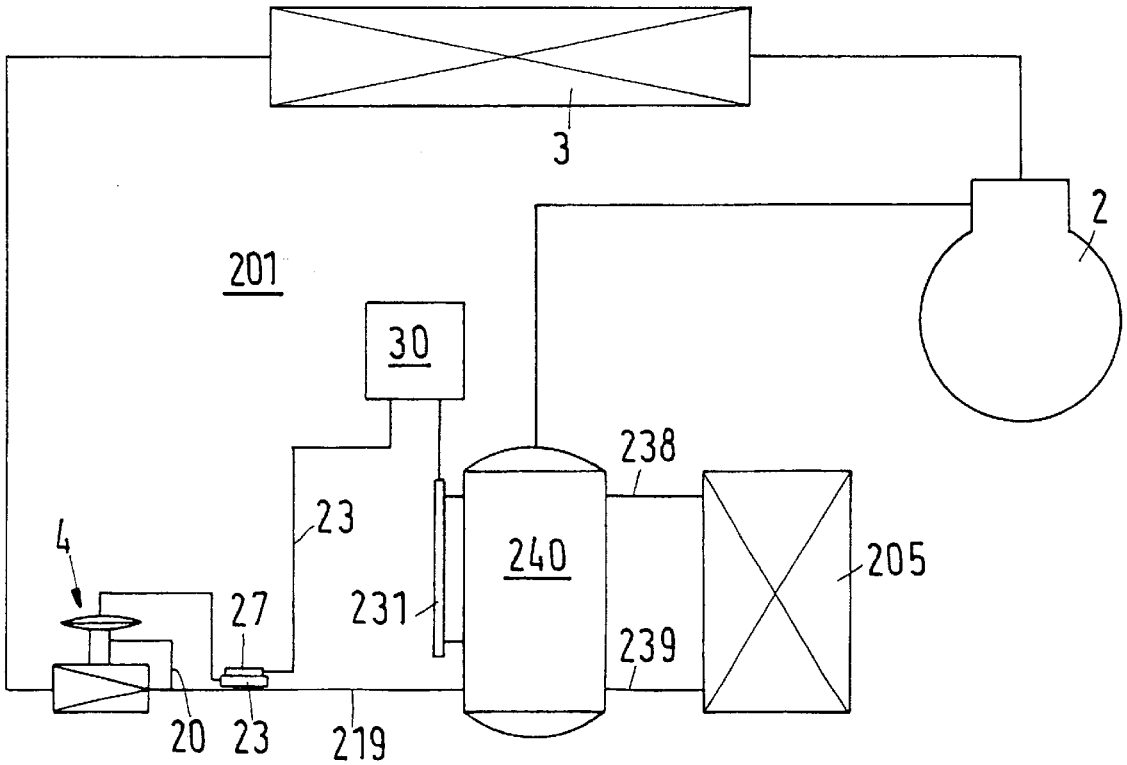
FIG. 5 is a circuit diagram of a modified refrigeration system according to the invention with a flooded evaporator.

With the refrigeration system 201 in FIG. 5, for identical parts the same reference numbers as in FIG. 1 are used, and for modified parts reference numbers increased by 200 are used. Here, a flooded evaporator 205 is used, which is connected by an upper line 238 and a lower line 239 to a collector 240. In the form of a mixture of liquid and vapour, the refrigerant flows back via the upper line 238 into the collector 240, whilst liquid refrigerant flows via the lower line 239 to the evaporator 205. This circulation takes place automatically, but can also be assisted by a pump. A fill level indicator 231 informs the controller 30 of the liquid level and the controller sets the opening degree of the expansion valve 4 so that a desired fill level is maintained.

In the case of the sensor 323 illustrated in FIG. 6, the heating element 327 is arranged inside the sensor. Such a sensor can be secured to the refrigerant line 19 using a retaining means similar to the retaining device 28.

Refrigeration systems having several evaporators connected in parallel can also, of course, be operated in the described manner. In that case the sensor can be arranged either before the distributor or in one of the branch lines after the distributor. Superheat can also be measured in a manner other than as illustrated in FIG. 1, for example by a temperature sensor before and a temperature sensor after the evaporator. The pipe-form compensating channel of FIG. 1 can also be combined with the sensor associated with the housing according to FIG. 5, or conversely the internal compensating channel according to FIG. 5 can be combined with the sensor according to FIG. 1 or 6 located on the refrigerant line.

Figure 7:
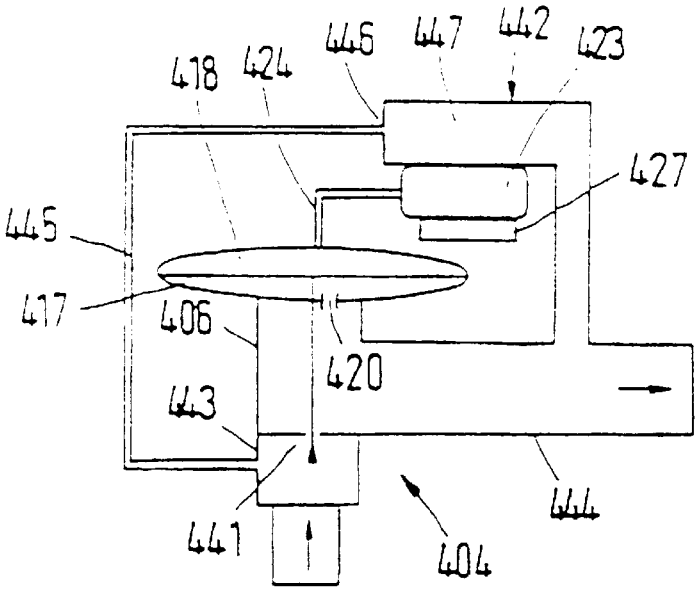
FIG. 7 is a diagrammatic view of a further alternative of a modified expansion valve, FIG. 8 a section of a further embodiment of a refrigeration system according to the invention, FIG. 9 a further embodiment of an expansion valve.

FIG. 7 shows a diagrammatic view of an expansion valve 404, whose locking piece, together with the valve seat, forms a first throttling point 441. A bypass channel 442 bridges this throttling point 441. It leads from the inlet connector 443 of the valve housing 406 to the outlet connector 444, and comprises in series a line section 445 with small cross section, a fixed second throttling point 446 in the shape of a small opening, and an expansion chamber 447. A sensor 423 is mounted on the wall of the expansion chamber 447, which sensor is in thermal contact with a heating element 427 on the opposite side, and is connected with the upper pressure chamber 418 via a capillary tube 424. The pressure chamber 417 is acted upon by the outlet side pressure of the refrigerant.

With this construction the refrigerant in the expansion chamber 447 assumes the saturation temperature, which is also the temperature of the refrigerant at the outlet of the expansion valve 404.

Figure 8:
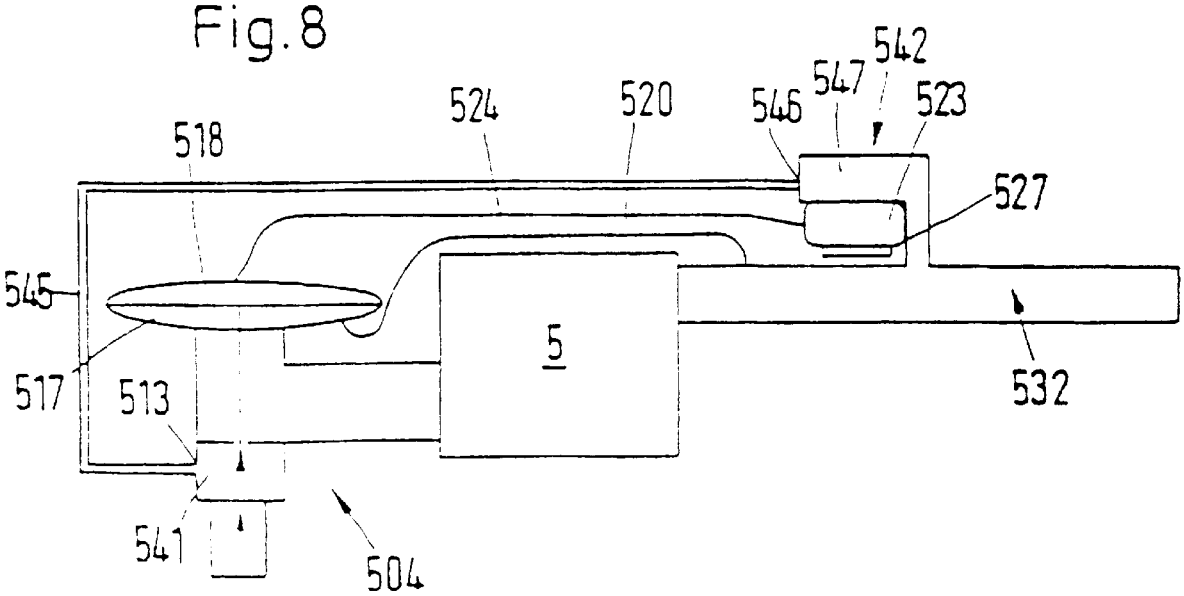

In the embodiment according to FIG. 8, reference numbers increased by 100 are used for corresponding parts in FIG. 7. As opposed to FIG. 7, the bypass channel 542 does not only bridge the first throttling point 541 of the expansion valve 504, but also the complete evaporator 5, that is, it leads from the inlet connector 543 of the expansion valve 504 to the outlet line of the evaporator 5. Again, the sensor 523 is mounted on the wall of the expansion chamber 547 and is heated by a heating element 527. To take into consideration the pressure drop in the evaporator 5, the pressure chamber 517 is connected with the outlet line 532 via a compensating channel 520 in the shape of a capillary tube.

Figure 9:
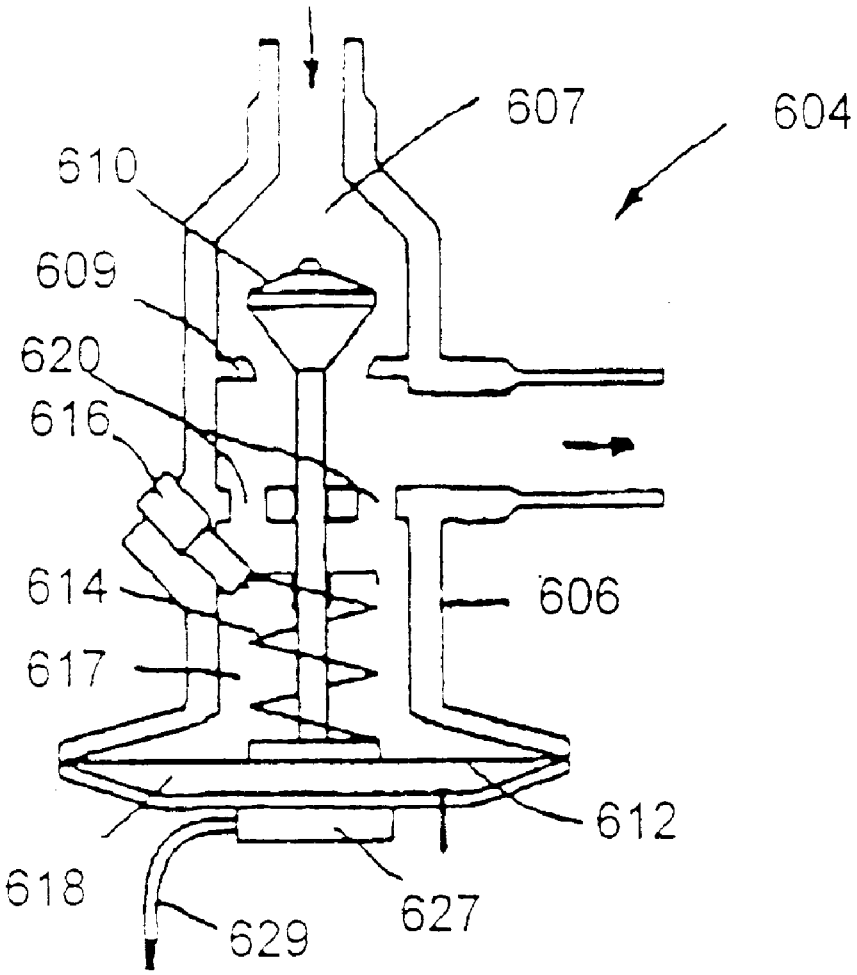

FIG. 9 shows an additional modified form of an expansion valve, in which reference numbers of corresponding parts are increased by 600 in relation to FIGS. 1 to 3.

Initially, it can be seen that the valve 604 in FIG. 9 has been turned in relation to the previously shown embodiments. In this embodiment of the invention, the compensating channel 620 is arranged inside the valve 604, like in FIG. 4. Otherwise, the valve 604 is substantially equal to that shown in FIG. 2.

In the embodiment in FIG. 9 a separate sensor is not provided. Instead, the heating element 627 is arranged direct on the housing 606 of the valve 604 on the sensor chamber 618. An electrical cable 629 leads to the controller 30, as described above.

In this embodiment of the invention, the heat is led direct to the sensor chamber 618 through the heating element 627, without requiring a separate sensor or capillary tube. This makes the valve 604 simpler than the embodiments of the invention shown above. To provide a correct and effective heating of the medium in the sensor chamber 418, however, the valve 604 must be turned.

The mode of operation according to the invention will now be described in detail. In each form of the invention, be it with separate sensors 23, 123, 323, 423 or 523, or the embodiment in which the heating element 627 supplies the heat direct to the expansion valve 604, the valve opens, when the pressure in the sensor chamber 18 exceeds the sum of the pressure in the pressure chamber 18 and the power of the spring 14. In the embodiment of the invention using a sensor, most of the energy provided by the heating element 27, 127 or 327 will flow into the medium inside the sensor, even though a small share will flow through the wall of the sensor past the medium. Heat from the heating element causes the liquid medium to boil, and vaporised refrigerant throws bubbles upwards to the upper part of the sensor, where the temperature is lower. The refrigerant vapour condenses under dissipation of heat to the upper side of the sensor, which is mounted on the outlet of the expansion valve. At the same time, the pressure inside the sensor increases, this pressure being applied on the sensor chamber 18, and the valve opens.

In a similar way, in the embodiment according to FIG. 9, heat produced by the heating element 627, is brought direct into the medium, which is arranged inside the sensor chamber 618. Heat from the heating element causes the liquid medium in the sensor chamber 618 to boil, which increases the pressure inside the sensor chamber 618 and thus opens the valve 604. At the same time refrigerant bubbles rise upwards in the sensor chamber 618 to areas in which the temperature is lower. Here the vapour condenses under dissipation of heat to the surrounding liquid, and the heat is then led through the actuator 612 into the pressure chamber 617. Thus, there is a constant transfer of heat to the refrigerant flowing through the valve 604, in the same way as in the first embodiment of the invention, in which there is a constant heat transfer from the sensor 23, 123 or 323 to the outlet pipe 19 coming from the evaporator valve.

What is claimed is:

1. In a refrigeration system comprising in series a compressor, a condenser, an expansion valve and an evaporator, a method of controlling the refrigeration system by means of the expansion valve, the expansion valve comprising an actuator having one of a diaphragm and a bellows and being arranged to be acted upon by heat supplied by a heating element, comprising the steps of biasing one side of the actuator by refrigerant pressure from the evaporator, biasing the other side of the actuator vapour pressure of a sensor system whose pressure is temperature dependent, determining the temperature of the sensor system by the saturation temperature of the refrigerant and by the heat supplied by the heating element, and measuring one of superheat on the outlet side of a dry evaporator and the liquid level of a flooded evaporator and regulating heat supplied by the heating element in dependence on the measured superheat.

2. Method according to claim 1, in which one side of the actuator is acted upon by the refrigerant on the outlet side of the expansion valve.

3. Method according to claim 1, in which the sensor temperature at the outlet side of the expansion valve is influenced by the saturation temperature of the refrigerant.

4. Method according to claim 1, in which part of the refrigerant is led past a throttling point of the expansion valve and including a fixed second throttling point, the sensor being located after the second throttling point and being influenced by the saturation temperature of the refrigerant.

5. Refrigeration system comprising in series a compressor, a condenser, an expansion valve having an inlet and an outlet, and an evaporator, the expansion valve comprising an actuator divided into two pressure chambers, one of a diaphragm and a bellows dividing the chambers and being arranged to be acted upon by heat provided by means of a heating element, a compensating channel connecting one of the pressure chambers with a refrigerant path leading to the evaporator, the other pressure chamber comprising part of a sensor system having a sensor fluid whose pressure is temperature dependent, the sensor system having a sensor in thermal contact with refrigerant at the outlet of the expansion valve and with the heating element, and a controller connected to control the heating element in dependence on one of superheat at an outlet of the evaporator and on the liquid level of a flooded evaporator.

6. Refrigeration system, comprising in series a compressor, a condenser, an expansion valve having an inlet and an outlet, an evaporator and a bypass channel bridging a throttling point of the expansion valve and a fixed second throttling point at a subsequent expansion chamber, the expansion valve comprising an actuator having one of a diaphragm and a bellows dividing two pressure chambers and being acted upon by heat supplied by a heating element, one pressure chamber being connected to an evaporator side refrigerant path via a compensating channel, the other pressure chamber being part of a sensor system having a sensor fluid, whose pressure is temperature dependent, the sensor system having a sensor in heat-exchange with refrigerant in the expansion chamber and with the heating element, and a controller connected to control the heating element in dependence on one of superheat at an outlet of the evaporator and the liquid level of a flooded evaporator.

7. Refrigeration system according to claim 6, in which the bypass channel is a capillary tube.

8. Refrigeration system according to claim 6, in which the compensating channel is connected to the outlet of the expansion valve.

9. Refrigeration system according to claim 6, in which at least one of the compensating channel and the sensor is closely adjacent to the expansion valve.

10. Refrigeration system according to claim 5, in which the compensating channel comprises a pipe that connects a refrigerant line adjoining the outlet of the expansion valve to a connector leading to one of the pressure chambers.

11. Refrigeration system according to claim 5, in which the compensating channel is located inside the valve.

12. Refrigeration system according to claim 5, in which the sensor is connected by a capillary tube to the other pressure chamber.

13. Refrigeration system according to claim 5, in which the sensor is situated on the refrigerant line adjoining the outlet of the expansion valve and is contacted by the heating element.

14. Refrigeration system according to claim 13, in which the sensor and the heating element are secured to the refrigerant line by a retaining device.

15. Refrigeration system according to claim 5, in which the sensor is arranged at a housing part of the expansion valve located on the outlet side and is contacted by the heating element.

16. Refrigeration system according to claim 15, in which the sensor comprises a chamber in the housing part located on the outlet side.

17. Refrigeration system according to claim 7, in which the sensor is mounted on a wall of the expansion chamber.

18. Refrigeration system according to claim 7, in which the bypass channel bridges the evaporator and that the compensating channel is connected with the refrigerant line downstream of the evaporator.

19. Refrigeration system according to claim 7, in which on the outlet side of the expansion valve the bypass channel flows into the refrigerant line.

20. Refrigeration system according to claim 5, in which the heating element is arranged inside the sensor.

21. Refrigeration system according to claim 5, in which at least one of the sensor and the heating element is covered by a heat insulation.

22. Expansion valve for a refrigeration system, having a valve housing having an inlet and an outlet, and a valve seat located between an inlet chamber and an outlet chamber, an actuator located between two pressure chambers, the actuator comprising one of a diaphragm and a bellows for the operation of a closure member, and including a heating element, a compensating channel connecting the outlet chamber and one of the pressure chambers and the other pressure chamber comprising part of a sensor system filled with a sensor fluid, the sensor system having a sensor located for heat-exchange with outlet refrigerant from the expansion valve and with the heating element.

23. Expansion valve according to claim 22, in which the valve housing, the compensating channel and the sensor system form a pre-assembled module.

24. Expansion valve according to claim 22, in which the sensor is connected by a capillary tube to the other pressure chamber.

25. Expansion valve according to claim 22, in which the sensor is located proximate the valve housing.

26. Expansion valve according to claim 23, in which a refrigerant line adjoining the valve outlet is part of the module and serves as carrier for the sensor and the heating element.

27. Expansion valve according to claim 22, in which the heating element is located externally on the sensor.

28. Expansion valve according to claim 22, in which the heating element is located inside the sensor.

29. Expansion valve according to claim 22, in which the compensating channel comprises a pipe which connects the outlet refrigerant with the one pressure chamber.

30. Expansion valve according to claim 22, in which the compensating channel is located inside the valve housing.

31. Expansion valve according to claim 22, in which the inlet and the outlet of the expansion valve are connected by a bypass channel having a fixed throttling point with an adjacent expansion chamber, and the sensor is mounted on a wall of expansion chamber.

* * * * *